US009947249B1

(12) United States Patent
Baldwin

(10) Patent No.: US 9,947,249 B1
(45) Date of Patent: Apr. 17, 2018

(54) SEGMENTED SIGN FRAME

(71) Applicant: Timothy Mark Baldwin, Scottsdale, AZ (US)

(72) Inventor: Timothy Mark Baldwin, Scottsdale, AZ (US)

( * ) Notice: Subject to any disclaimer, the term of this patent is extended or adjusted under 35 U.S.C. 154(b) by 0 days.

(21) Appl. No.: 15/211,292

(22) Filed: Jul. 15, 2016

Related U.S. Application Data

(60) Provisional application No. 62/192,929, filed on Jul. 15, 2015.

(51) Int. Cl.
*G09F 15/00* (2006.01)

(52) U.S. Cl.
CPC ..... *G09F 15/0012* (2013.01); *G09F 15/0037* (2013.01)

(58) Field of Classification Search
CPC ..... G09F 1/12; A63A 33/042; A63A 33/086
See application file for complete search history.

(56) References Cited

U.S. PATENT DOCUMENTS

| | | | | |
|---|---|---|---|---|
| 3,242,610 | A * | 3/1966 | Christiansen | A63H 33/086 446/128 |
| 4,117,614 | A * | 10/1978 | Bickford | G09F 1/12 40/741 |
| 4,288,937 | A * | 9/1981 | Virsen | G09F 15/0068 211/182 |
| D319,267 | S * | 8/1991 | Hoyer | D21/503 |
| 5,645,463 | A * | 7/1997 | Olsen | A63H 33/042 446/104 |
| D608,400 | S * | 1/2010 | Ryaa | D21/500 |
| 2005/0160652 | A1* | 7/2005 | Moody | A63H 33/086 40/741 |

* cited by examiner

*Primary Examiner* — Cassandra H Davis
(74) *Attorney, Agent, or Firm* — Cahill Glazer PLC

(57) ABSTRACT

A sign frame incorporates a plurality of segments each selected from straight, curved or hinged segments that are interchangeable and are telescopically connected to adjacent segments. The selection of curved and straight segments may provide for customization of the sign size, while selection of hinge segments can be integrated with other segments to provide a hinge support for the sign and sign frame and for convenient attachment to a pole or post.

10 Claims, 5 Drawing Sheets

SEGMENTED SIGN FRAME

RELATED APPLICATIONS

This application is related to and claims priority to a provisional application entitled "SEGMENTED SIGN FRAME" filed Jul. 15, 2015, and assigned Ser. No. 62/192,929.

FIELD OF THE INVENTION

The present invention is directed to sign frames for receiving and supporting planar signs and mounting or attaching the signs to posts or poles to permit display of the sign.

BACKGROUND OF THE INVENTION

Signs of the type used for advertising products and which are typically attached to posts or utility poles conventionally incorporate frames that are dimensioned to receive a specific sign size. When mounted, the signs are subjected to wind forces which can sometimes dislodge the sign or damage the sign to the extent it is no longer capable of performing its task—that is, to present advertising messages to observers. A variety of sign frame sizes are required to accommodate the various signs, shapes, and sizes; further, the accumulation of an inventory of unused sign frames can be an inefficient and expensive business investment that would normally be required to have available a proper sign frame size to accommodate the constant change of sign sizes required by the advertiser.

SUMMARY OF THE INVENTION

The present invention incorporates a segmented sign frame incorporating a plurality of telescoping frame sections. Each frame section is provided with an open end to receive an extension of an adjacent section and also includes an extension opposite to the open end for extending into the open end of another adjacent section to thus form a telescoping connection. Straight sections are provided to form a side, top and bottom of a rectangular frame, and curved sections are provided to form corners of such frame. Such segmented frame can be assembled to accommodate any size of planar sign. A typical sign is rectangular; however, other sign shapes could be accommodated by appropriate modification of the frame sections.

Curved sections are provided that also telescopically connect with adjacent sections but are curved between the curve section open end and the corresponding extension. The curve is typically 90°, but other angles may be incorporated depending on the sign to be supported. In the embodiment chosen for illustration, all frame sections incorporate slots extending longitudinally thereof along one edge of the section to receive and support the edge of a planar sign. The curved sections also have slots that register with the slots of adjacent sections; however, the slots of the curve sections can be on the inside of the curve section or up on the outside of the curve section to provide flexibility in the shape of the sign to be supported.

Master sections or hinge sections are provided and are telescoping in the same manner as the sections described above but are formed with a flexible web extending from the section to a hinge base that is adapted to be secured to a sign supporting post or pole. The web, formed integrally with the hinge section, extends from the sign supporting portion of the section to a hinge base. The web is flexible and provides support from the post or pole to the sign frame and thus to the sign. The flexible hinge portion can flex perpendicularly to the direction of the surface of the supported sign. The hinge section base is formed in an arcuate shape to conform to a post or pole to which the sign is to be mounted. If the post or pole has a larger radius than the radius of the arcuate shape of the base, or the post has a rectangular/square cross-section, the base may nevertheless be secured to the pole with the arcuate portion incorporating enlarged pole-contacting lips that properly orient the hinge section longitudinally parallel with the post or pole. The base of the hinge sections include openings or slots extending through the base to admit a securing means such as a flexible fabric or metal strap or clamp to secure the hinge section base, and thus the hinge section and supported sign, to the post or pole.

The flexible web is generally planar and parallel to the plane of the sign being supported by the frame. It flexes in the direction perpendicular to the plane of the sign but incorporates sufficient positioning memory to return to its original position after flexing forces (e.g. wind forces on supported sign) are removed.

The web, and the integrally formed hinge section, are formed of a suitable polyethylene copolymer known for its strength, durability, and positional memory. A typical polyethylene compound may be obtained under the designation of G50-100 Polyethylene Copolymer, a high molecular weight, a high density polyethylene copolymer developed for sheet extrusion, thermoforming, and large part blow molding. The material exhibits appropriate strength for operating as a hinge section to support the weight of the sign frame and frame and presents sufficient positioning memory to permit the flex of the sign and frame in response to wind forces while nevertheless responding to the cessation of those forces to resume its original position.

BRIEF DESCRIPTION OF THE DRAWINGS

The present invention may more readily be described by reference to the accompanying drawings in which.

DETAILED DESCRIPTION OF THE INVENTION

Figure 1:
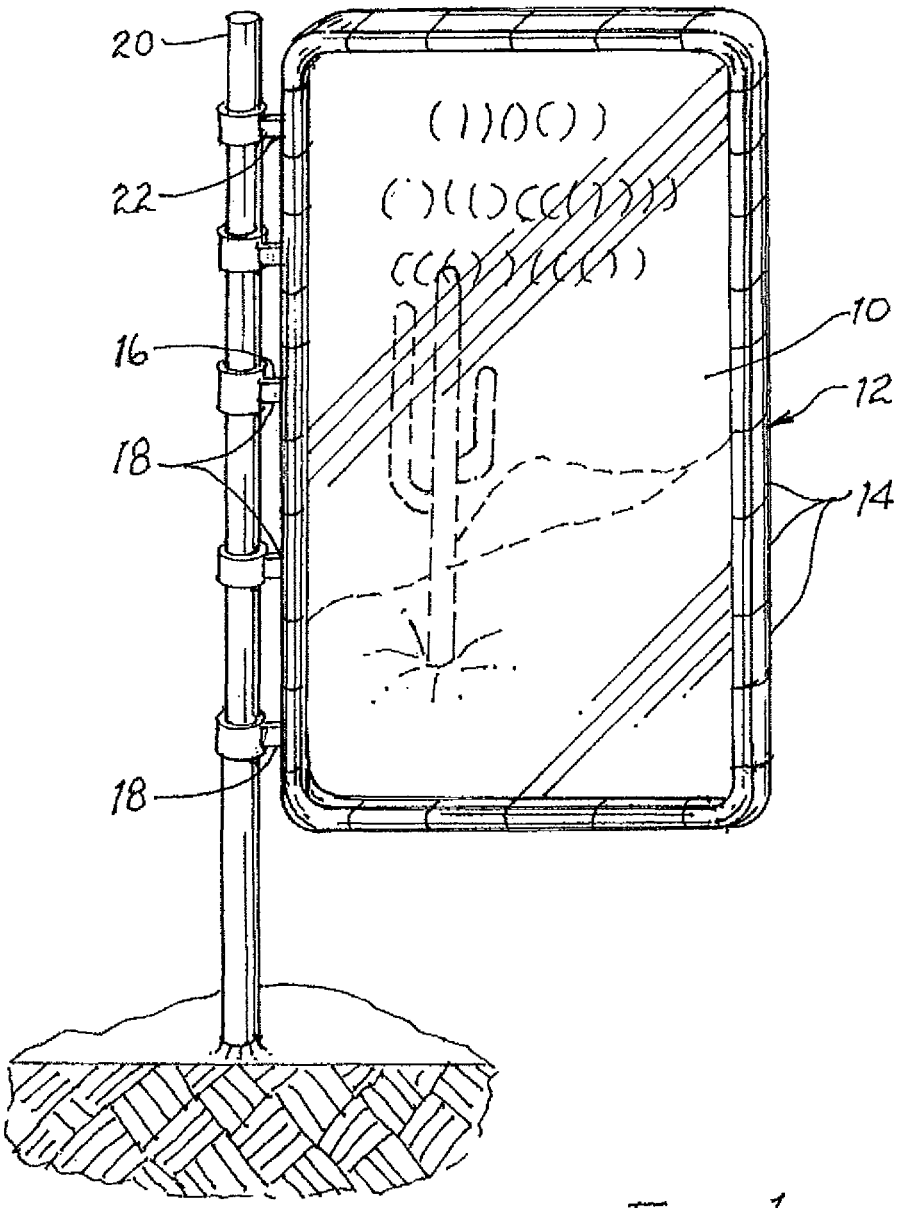
FIG. 1 is an illustration of a segmented sign constructed in accordance with the teachings of the present invention and showing the sign secured to a vertical post or pole.

Referring to FIG. 1, a segmented sign constructed in accordance with the teachings of the present invention is shown. The sign 10 is a conventional rectangular planar sign containing advertising material on the surfaces thereof.

The sign is supported by a segmented sign frame 12 incorporating a plurality of frame sections 14, each section is telescopically connected to the adjacent sections while hinge sections 16, telescopically connected to adjacent sections, include flexible webs 18 extending from the hinge section to a hinge base secured to the post or pole 20 by corresponding flexible fabric or metal straps 22.

Figure 2B:
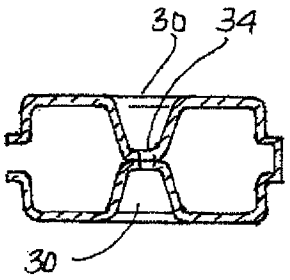
FIGS. 2*a*, 2*b*, 2*c*, 2*d* and 2*e* are top, end, side, and cross-sectional views of a straight section of the segmented sign frame of the present invention.
Figure 2E:
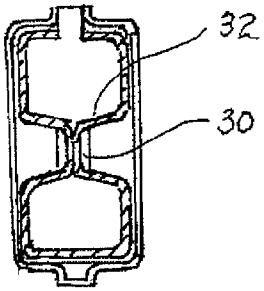
Figure 2A:
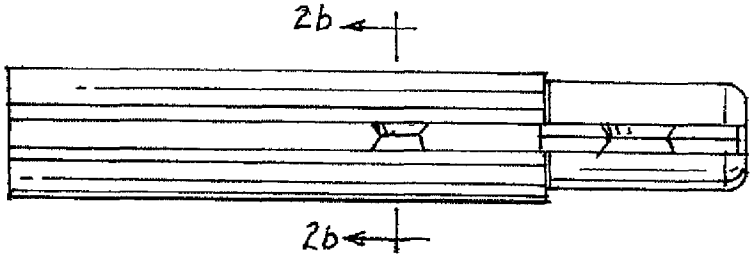
Figure 2D:
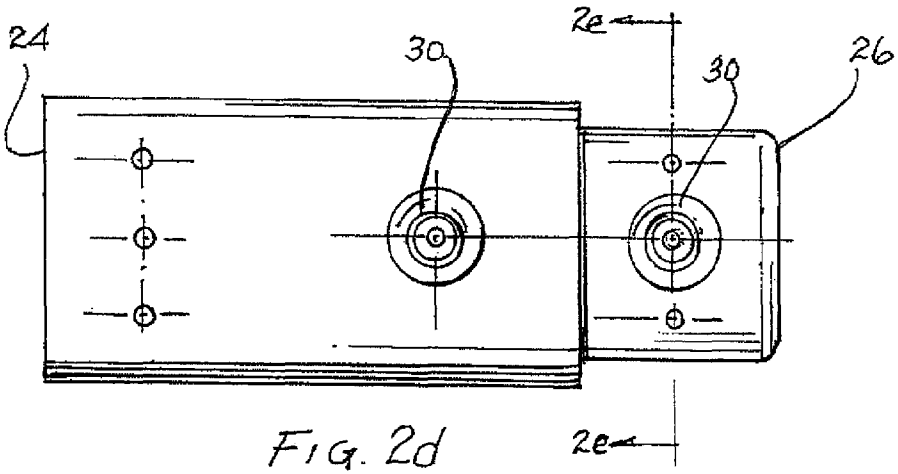
Figure 2C:
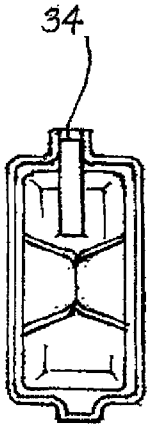
Figure 3E:
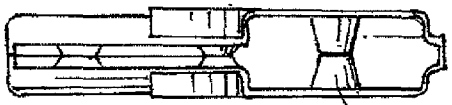
FIGS. 3*a*, 3*b*, 3*c*, 3*d* and 3*e* are a perspective, side, top, bottom and cross-sectional view of a curved section of the segmented sign frame of the present invention.
Figure 3B:
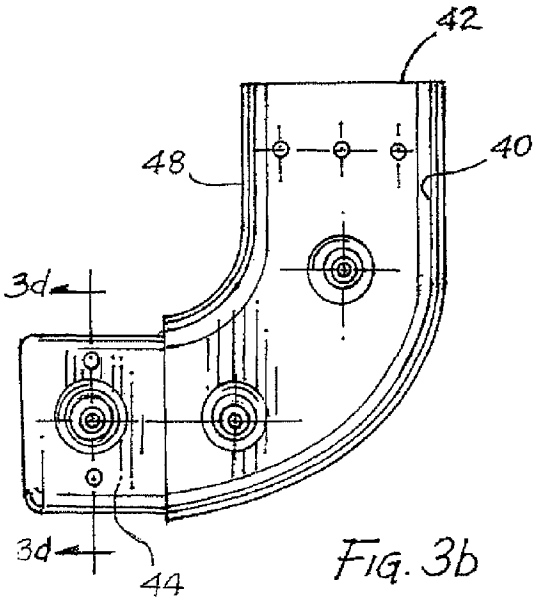
Figure 3C:
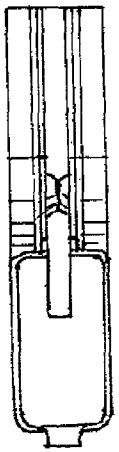
Figure 3D:
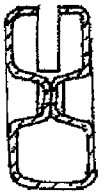
Figure 3A:
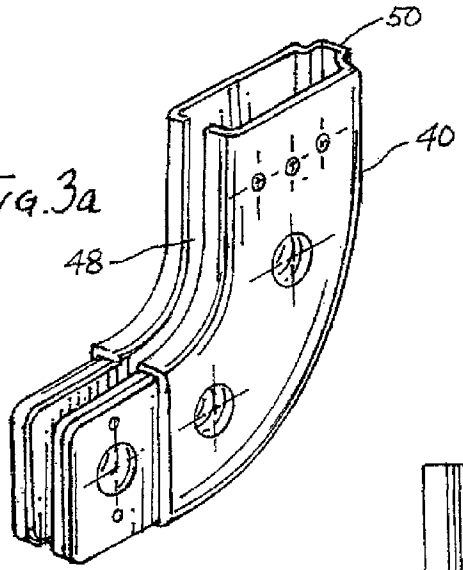

Referring to FIGS. 2*a*-2*c*, a straight section is shown wherein it may be seen that the section includes an open end 24 and an extension 26 positioned opposite the open end. The extension 26 is sized to be received by and to be inserted in a corresponding open end 24 of an adjacent section to thus provide a telescopic positioning connection. The section includes cylindrical indentations 30 that can provide strengthening of the section while in the illustrated embodiment provides a contact surface 32 to receive the edge of a planar sign being supported. This surface 32 helps to position the planar sign while it is being supported by the section. The section also includes a longitudinally extending slot 34 along one edge of the section to receive and support a corresponding edge of a planar sign to be supported by the frame.

Referring to FIG. 3*a*-3*e*, a curved section is shown. The section chosen for illustration is a 90° curve that would typically form the corners of a rectangular frame to support the conventional rectangular planar sign. However, it is possible that the angle chosen for the corner may be other than 90° to accommodate signs with a shape other than rectangular. It may be noted that the curved section 40 includes an open end 42 and an extension 44. Thus, the curved section is telescopically connected with adjacent sections in a manner described above in connection with the straight sections. It may be also noted that the curved section includes cylindrical indentations 46 to provide strengthening and to provide supporting surfaces for signs being supported by the frame in a manner similar to the cylindrical indentations described above in connection with FIG. 2. It may be noted that the embodiment shown in FIG. 3 includes a slot 48 extending along the interior of the curve of the curved section. This slot would receive the planar corner of the supported sign. The slot 48 extends along the interior of the curve of the curved section; however, to accommodate sign shapes that may include a curve extending away from the center portion of the sign, the slot 48 may be eliminated and replaced by a slot extending along the exterior of the curve 50. The positioning of the slot on the external edge of the curved section, as opposed to the interior curved edge permits a sign to be supported when the sign is other than a traditional rectangular shape and may have compound shapes.

Figure 4A:
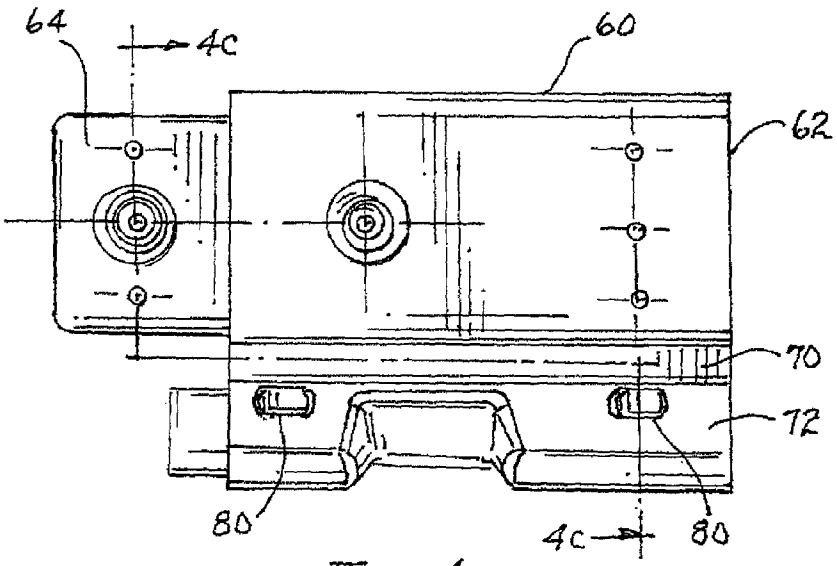
FIGS. 4*a*, 4*a*, and 4*c* are a side, top, and sectional view of a hinge section of the segmented frame of the present invention.
Figure 4B:
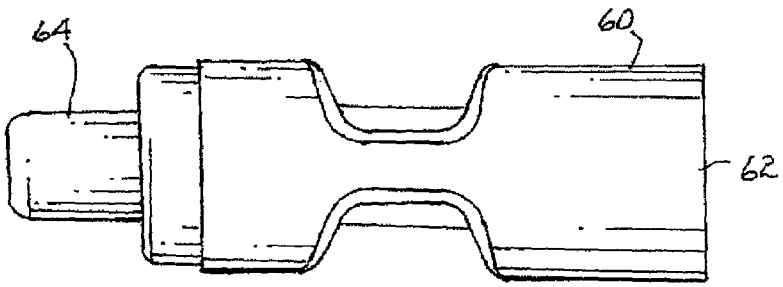
Figure 4C:
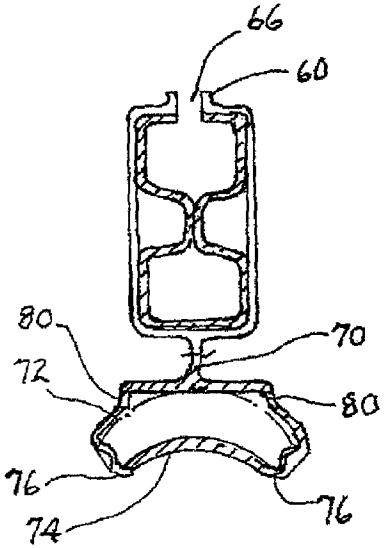

Referring to FIGS. 4*a*-4*c*, a hinge section 60 is shown wherein it may be seen that it is provided with an open end 62 and an extension 64 in a manner described above in connection with straight sections. Thus, this hinge section is connected to adjacent sections telescopically by the insertion of the extension 64 into the open end of an adjacent section while the open end 62 receives the extension of another adjacent section. In the illustrated embodiment, the hinge section includes a longitudinally extending slot 66 in a manner described above in connection with the straight sections but also includes a web 70 extending from the section and connected to a base 72. The web and base may be formed integrally with the upper portion of the hinge section 60 and includes an arcuate surface 74 to contact the corresponding surface of the post or pole to which the frame and sign are to be attached. As described above, it may be note that if the post or pole has a radius of curvature greater than the radius of curvature of the arcuate section 74, is rectangular or square thus resulting in a flat surface, contact surfaces 76 extending from the terminating edges of the arcuate section 74 are provided that will contact the post or pole surface and position the hinge section longitudinally parallel with the post or pole.

The base 72 is provided with a plurality of slots 80 to receive flexible fabric or metal straps to be used to circumscribe the post or pole and facilitate secure attachment of the hinge section, and thus the segmented frame and supported sign, to the post or pole. The respective extensions and open ends of the sections are sized identically; that is, the dimensions of the respective extensions and corresponding open ends are identical for all of the sections of the segmented frame. In that manner, the chosen sections, whether straight, curved, or hinged may be selected to be connected to an adjacent section to thereby permit a user to choose the number and type of section to accommodate any size sign and provide appropriate and adequate hinging connection to a post or pole.

Figure 5:
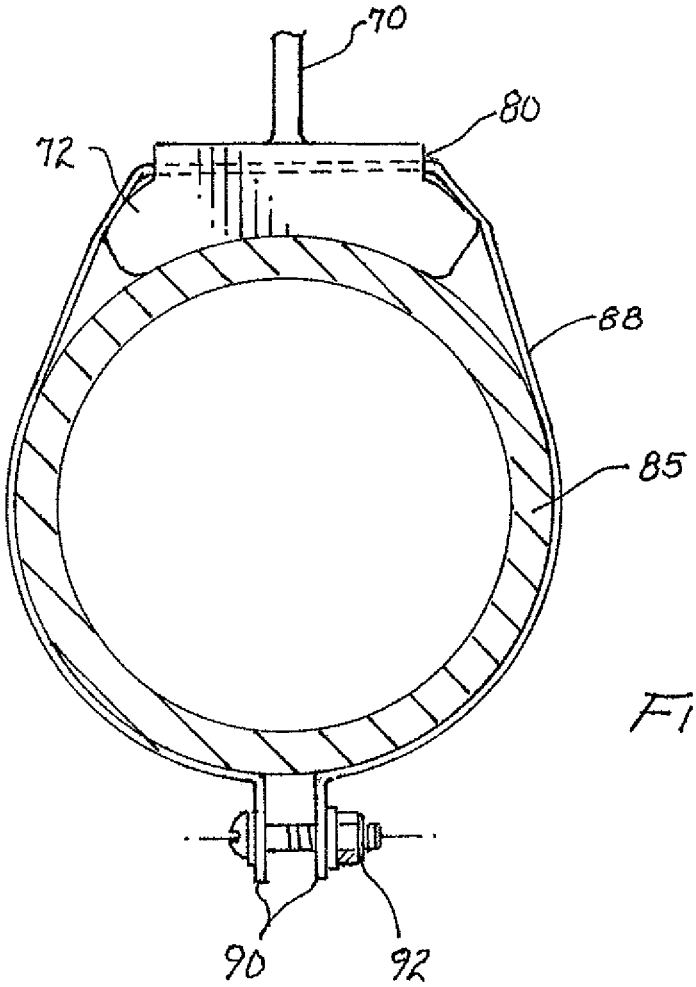
FIG. 5 is a cross-sectional view of a portion of the hinge section of FIG. 4C showing the hinge section secured to a post or pole.

Referring to FIG. 5, a cross-sectional view of a portion of a hinge section having a web 70 is shown wherein the base 72 is shown in contact with a post 85 and is held in place with a metal strap 88 extending through slot 80 and circumscribing the post 85. The strap 88 may be secured to the post 85 through opposing flanges 90 by a typical bolt and nut combination 92.

The embodiment chosen for illustration was directed to a segmented sign frame for supporting a flat planar sign, preferably of a rigid material, wherein the peripheral edges of the sign extend into slots provided in the segment sections of the sign frame. The slots of adjacent sections are aligned with each other to thus present a continuous slot to receive the sign edges. The sign extends into the corresponding slots and seats against supporting surface provided in the respective sections to thus firmly secure the sign within the segmented frame. Adjacent segments may be permanently or semi-permanently secured to each other through screws or bolts extending through the surface of a segment section, positioned at one end near the open end of the segment, to extend through the extension of the adjacent section that is telescopically inserted within the opened end of the section. Thus, the adjacent sections may be permanently secured. Alternative embodiments of the segmented sign frame may be formed as described above with the exception of the elimination of the slots such as the slot 48 in the curved section (FIG. 3A), the slot 34 in the straight section (FIG. 2B), or the slot 66 in the hinge section (FIG. 4C). When the slots have been eliminated, the segmented sign frame provides a rigid outline to which a planar sign may be attached by screwing or bolting the sign directly to the frame; alternatively, the segmented sign frame may be used as the internal support and shaping member to be inserted in a fabric or flexible pillow case sign construction wherein the flexible pillow case or sock is slipped over the sign frame and secured in place.

The segmented sign frame of the present invention permits the construction of sign frames to accommodate different sizes and shapes of signs by merely selecting standardized sections of the frame and assembling them to accommodate the chosen sign dimensions. Further, the selection of hinge segments permits the choice of the number and location of the hinge elements relative to the sign frame to accommodate the weight of the specific sign being supported. If the sign is to be replaced or updated, which is frequently the case, it is not necessary to obtain a new sign frame but merely to remove or add appropriate segments to accommodate the new dimensions of the replacement sign. Further, the movement or transport of prior art sign frames has been complicated by the dimensions and bulk of the frame which sometimes makes the delivery or transport of the sign frame awkward and expensive. The segmented sign frame of the present invention permits the individual segments to be conveniently packaged in conventional transport cartons without having to accommodate the size of the assembled frame.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed is:

1. A sign frame for supporting a planar sign comprising:

(a) a plurality of frame segments including straight sections, curved sections, and hinge sections;

(b) each of said sections having an open end at one end thereof and an extension at an opposite end thereof, said extensions sized to fit into an open end of an adjacent section to provide a telescoping connection between adjacent sections; and (c) said hinge sections having a flexible planar web extending therefrom to a base, said planar web parallel to the plane of a sign being supported by said frame, said base having an arcuate surface for contacting a supporting post or pole.

2. The sign frame of claim 1 wherein contact surfaces are provided extending from terminal edges of said arcuate surface for contacting a supporting post or pole when the post or pole has a radius of curvature greater than the radius of curvature of the arcuate section or has a rectangular or square cross-section.

3. The sign frame of claim 1 wherein each of said sections includes a slot, aligned with a slot of an adjacent section, for receiving an edge of a planar sign to contact and support the sign.

4. A sign frame for supporting a planar sign comprising:

(a) a plurality of frame segments including straight sections, curved sections, and hinge sections;

(b) each of said sections having an open end at one end thereof and an extension at an opposite end thereof, said extensions sized to fit into an open end of an adjacent section to provide a telescoping connection between adjacent sections;

(c) said hinge sections having a flexible planar web extending therefrom to a base, said planar web parallel to the plane of a sign being supported by said frame, said base having an arcuate surface for contacting a supporting post or pole; and (d) the open ends of each of said sections, and the extensions of each of said sections having identical dimensions respectively to permit any sections to be telescopically attached to any other section.

5. The sign frame of claim 4 wherein contact surfaces are provided extending from terminal edges of said arcuate surface for contacting a supporting post or pole when the post or pole has a radius of curvature greater than the radius of curvature of the arcuate section or has a rectangular or square cross-section.

6. The sign frame of claim 4 wherein each of said sections includes a slot, aligned with a slot of an adjacent section, for receiving an edge of a planar sign to contact and support the sign.

7. A sign frame comprising:

(a) a plurality of frame segments including straight sections, curved sections and hinged sections;

(b) said sections having an open end at one end thereof and an extension at an opposite end thereof, said extensions sized to fit into an open end of an adjacent section to provide a telescoping connection between adjacent sections;

(c) each of said hinge sections having a flexible web extending therefrom to a base; and (d) said base including a surface for contacting a supporting post or pole and including a slot to receive a strap for circumscribing a post or pole to secure the hinge section, and any sections attached to said hinge section, to the post or pole.

8. The sign frame of claim 7 wherein said surface is arcuate.

9. The sign frame of claim 8 wherein contact surfaces are provided extending from terminal edges of said arcuate surface for contacting and supporting a post or pole when the post or pole has a radius of curvature greater than the radius of curvature of the arcuate section or has a rectangular or square cross-section.

10. The sign frame of claim 7 wherein each of said sections includes a slot, aligned with a slot of an adjacent section, for receiving an edge of a planar sign to contact and support the sign.

* * * * *